United States Patent [19]

Feucht et al.

[11] Patent Number: 5,031,974

[45] Date of Patent: Jul. 16, 1991

[54] ORGANIZER CABINET

[75] Inventors: Mark A. Feucht, Champlin; Harold S. Klein, Wayzata; Stanley R. Thorud, Plymouth, all of Minn.; Mark Siedlecki; Andy Pis, both of Chicago, Ill.; Tony Toscano, Arlington Hgts., Ill.; Mario Perea, Naperville, Ill.

[73] Assignee: Liberty Diversified Industries, Inc., Minneapolis, Minn.

[21] Appl. No.: 504,572

[22] Filed: Apr. 4, 1990

[51] Int. Cl.[5] ..... A47B 47/00

[52] U.S. Cl. ..... 312/263; 312/108

[58] Field of Search ..... 312/257.1, 258, 259, 312/263, 108

[56] References Cited

U.S. PATENT DOCUMENTS

| | | | |
|---|---|---|---|
| 633,356 | 9/1989 | Carnahan | 312/257.1 X |
| 1,282,833 | 10/1918 | Holde | 312/257.1 X |
| 4,122,638 | 10/1978 | O'Brian et al. | 312/258 X |
| 4,201,428 | 5/1980 | Johnson | 312/263 X |
| 4,579,400 | 4/1986 | French | 312/257.1 |
| 4,836,626 | 6/1989 | Taylor et al. | 312/257.1 X |

FOREIGN PATENT DOCUMENTS 510509 10/1936 Fed. Rep. of Germany ... 312/257.1

OTHER PUBLICATIONS

Brochure Entitled "E-Z Stor Organizers Literature, Printout and Mail Distribution Product Specifications" Distributed by SAFCO Products Company, Undated.

Assembly Instructions for Model 8241 of the SAFCO E-Z STOR, Undated.

*Primary Examiner*—Joseph Falk

*Attorney, Agent, or Firm*—Merchant, Gould, Smith, Edell, Welter & Schmidt

[57] ABSTRACT

A cabinet is disclosed which includes a frame defining a cabinet interior. A plurality of dividers separate the cabinet interior into a plurality of storage compartments. The frame includes opposing side walls and top and bottom walls. The top wall is attached to the side walls by first and second mounting plates carried on the side walls and top wall, respectively. The first plate is resiliently urged against the side wall. The second plate is sized to be received between the first plate and the side wall, with latch mechanisms for holding the attaching plates in position.

7 Claims, 6 Drawing Sheets

ORGANIZER CABINET

I. BACKGROUND OF THE INVENTION

1. Field of the Invention

This application pertains to an organizer cabinet. More particularly, this invention pertains to such a cabinet having a frame of novel construction for defining a cabinet interior which receives a plurality of dividers.

2. Description of the Prior Art

Organizer cabinets are well known in the art. Representative examples of such are shown in the brochure of Safco Products Company, New Hope, Minn., entitled "EZ Stor® Organizers for Literature, Printout and Mail Distribution Product Specifications". The organizer cabinet shown in the brochure includes a metal, rectangular frame which define a cabinet interior. A plurality of divider elements are placed within the interior to divide the cabinet interior into a plurality of storage compartments. The manner of construction of the various elements and their assembly is best understood with respect to the assembly instructions for Model 8241 of the Safco® EZ Stor®.

As shown in the aforesaid publications, the frame is constructed by piecing together side walls, top walls, bottom walls, and an intermediate shelf. The walls are joined by a plurality of hardware items such as nuts and bolts.

While the foregoing design of organizer cabinets is effective, improvements in the design are desirable. For example, it is desirable to provide an organizer cabinet which can be assembled quickly by unskilled personnel. It is also desirable to provide an organizer cabinet which, when assembled, has exposed surfaces which are free of unsightly connecting hardware.

It is an object of the present invention to provide an organizer cabinet which is easy to assemble. It is a further object of the present invention to provide such a cabinet which can be manufactured at low cost. A still further object of the present invention is to provide an organizer cabinet which is free of unsightly connecting hardware on exposed surfaces.

II. SUMMARY OF THE INVENTION

According to a preferred embodiment of the present invention, an organizer cabinet is disclosed having a frame defining a cabinet interior with dividers carried in the frame for dividing the interior into a plurality of storage compartments. The frame includes a plurality of walls such as opposing side walls and opposing top and bottom walls. The top wall is attached to the side walls by first and second mounting plates carried on the side and top walls, respectively. The first mounting plate is resiliently urged against the side wall and the second mounting plate is disposed to be slid between the side wall and the first mounting plate. A latch mechanism is provided for latching the second mounting plate between the first side wall and the second mounting plate.

III. BRIEF DESCRIPTION OF THE DRAWINGS

IV. DESCRIPTION OF THE PREFERRED EMBODIMENT

Figure 1:
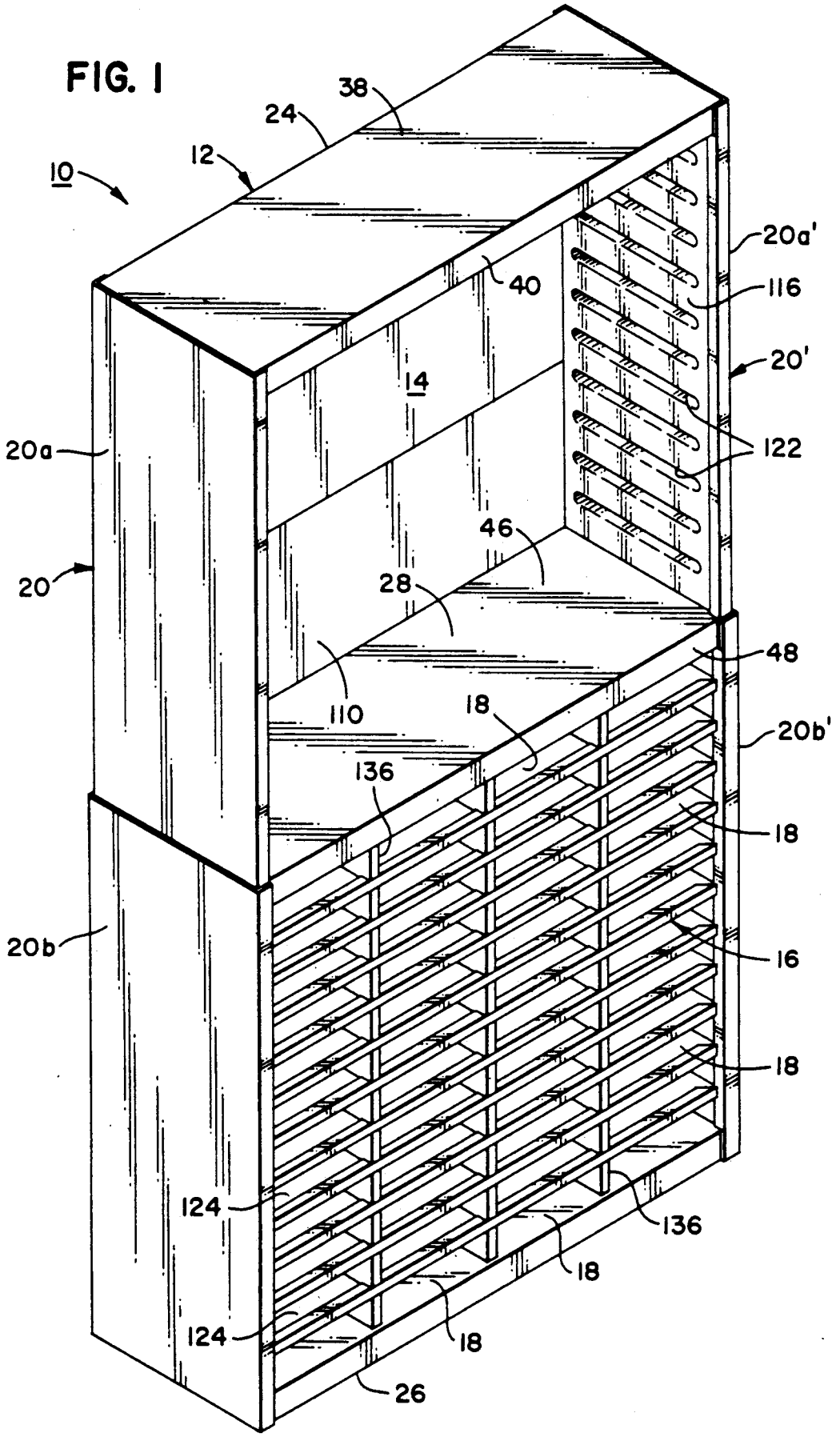
FIG. 1 is a top, left side and front perspective view of an organizer cabinet according to the present invention showing dividers in the bottom half of the cabinet.

Referring now to the several drawing figures in which identical elements are numbered identically throughout, a description of the preferred embodiment will now be provided.

An organizer cabinet 10 is shown comprising a frame 12 which defines the cabinet interior 14. A divider system 16 is received within interior 14 and subdivides interior 14 into a plurality of storage compartments 18.

The frame 12 is preferably constructed of sheet metal steel, and includes side walls 20, 20' top wall 24 and bottom wall or base 26. Side walls 20, 20' are mirror images of one another, and a description of side wall 20 will suffice as a description of side wall 20'.

Figure 2:
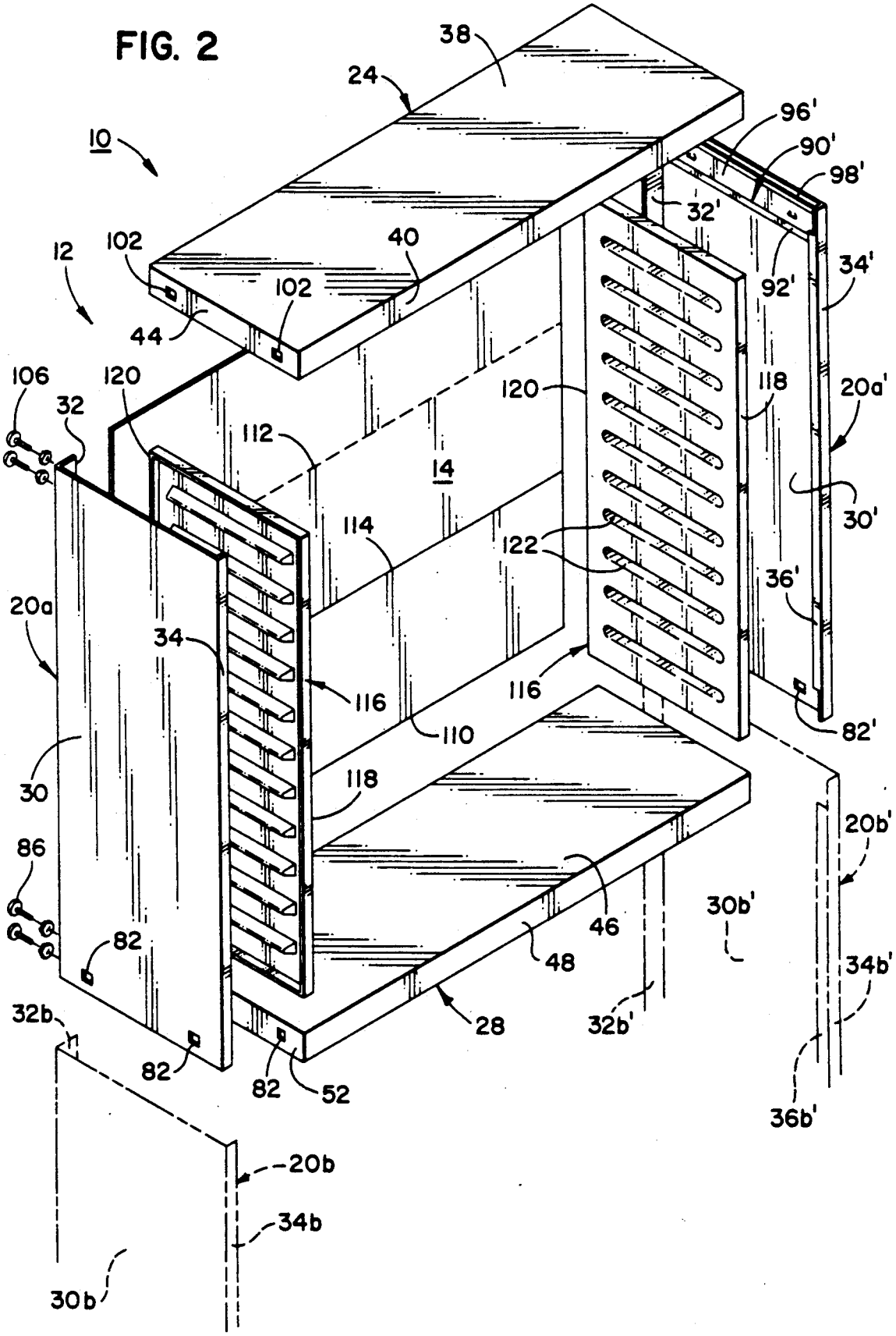
FIG. 2 is a top front and left side exploded perspective view showing the top half of the cabinet of FIG. 1.

Each of side walls 20, 20' includes upper and lower side wall half portions **20*a*, 20*b*, 20*a'* and 20*b'* (see FIGS. 1 and 2). Extending between side walls 20 and 20' at the point of juncture of halves 20*a*, 20*b*, 20*a'* and 20*b'* is an intermediate divider shelf 28**.

Figure 4:
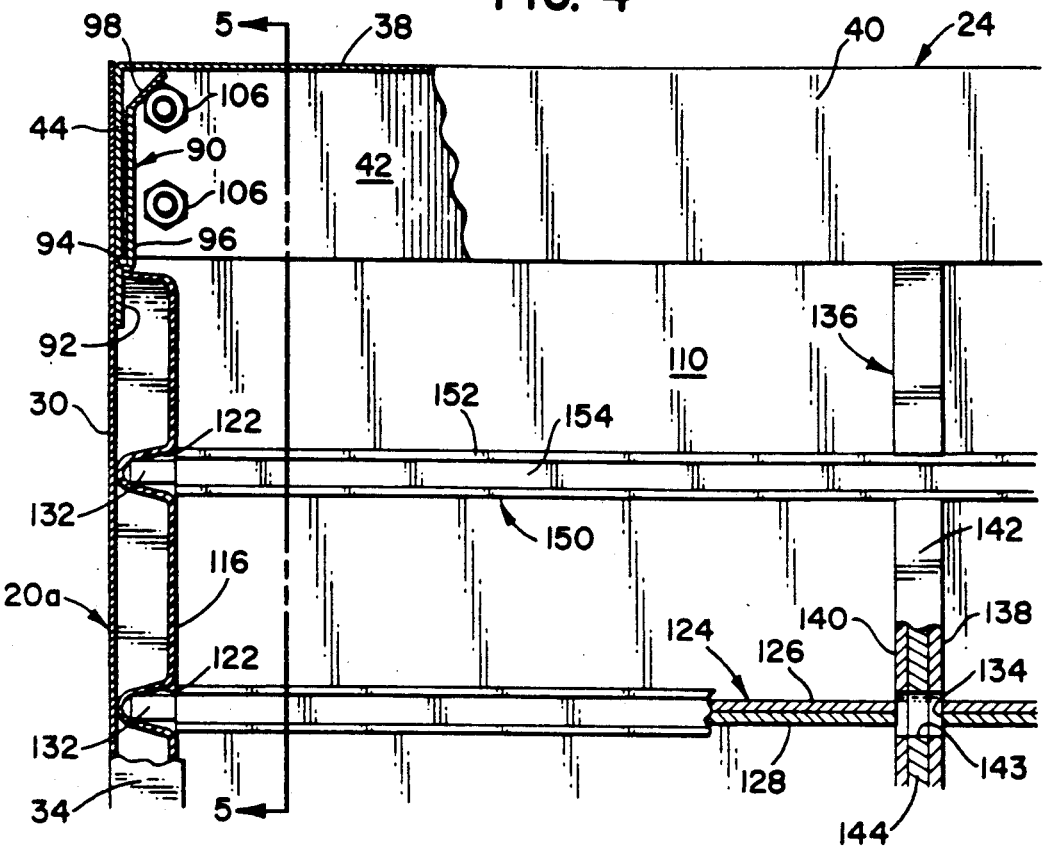
FIG. 4 is a front elevation view, taken partially in section, showing means for attaching side walls of the cabinet frame to a top wall.
Figure 5:
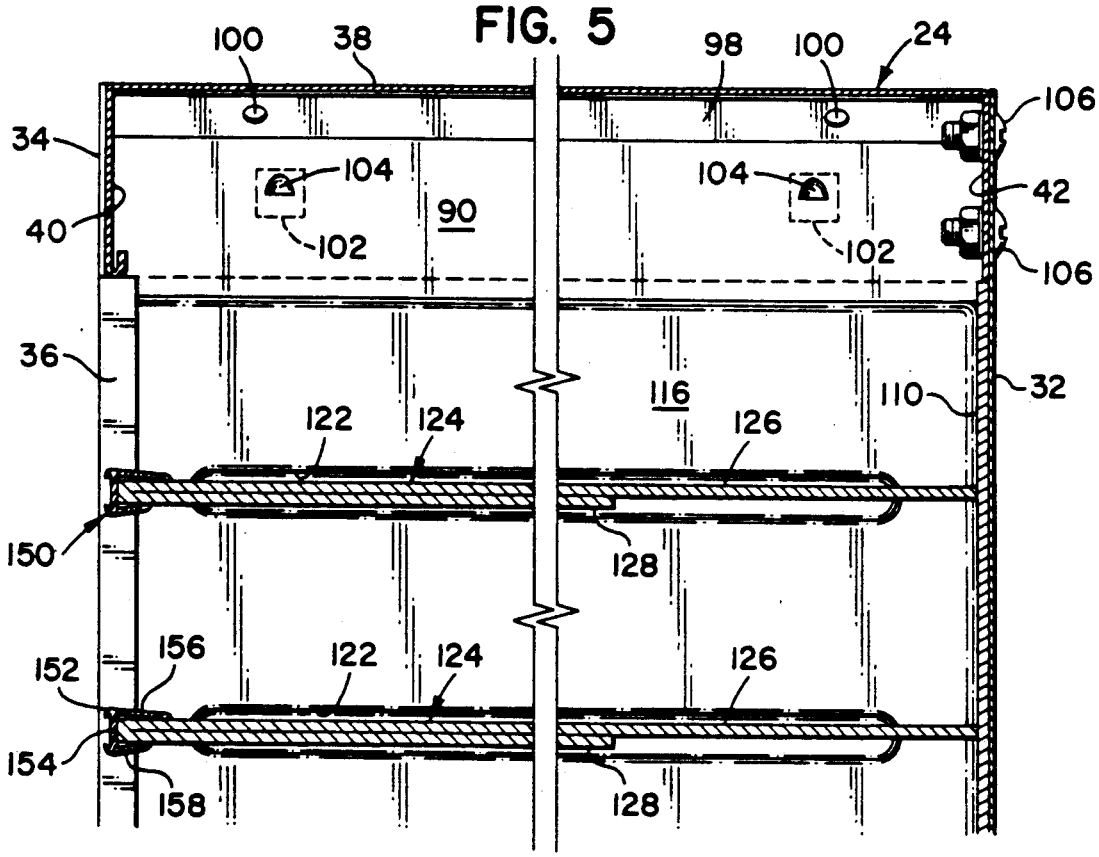
FIG. 5 is a view taken along line 5—5 of FIG. 4.

Shown best in FIGS. 2, 4 and 5, side wall **20*a* includes a flat main panel 30 having a rear edge flange 32 and forward edge flange 34. Shown best in FIGS. 2 and 4, forward edge flange 34 has an inwardly protruding lip 36. Each of portions 20*b*, 20*a'*, 20*b'* also include panels and flanges such as portion 20*a*. Accordingly, the same numbering for these elements is used in panels 20*b*, 20*a'* and 20*b'*. For reasons that will become apparent, bottom panels 20*b* and 20*b'* are sized to be slightly greater than panels 20*a* and 20*a'* such that panels 20*a* and 20*a'* may be slidably received within panels 20*b* and 20*b'***, respectively.

Top wall 24 includes a flat top panel 38, a forward edge flange 40, a back edge flange 42 and side edge flanges 44. Similarly, intermediate shelf 28 includes a top panel 46 having a forward edge flange 48, a rear edge flange 50 and side edge flanges 52.

Bottom wall or base 26 includes a top plate 54, front edge flange 56, rear edge flange 58 and side edge flanges 60. Disposed on an underside of top plate 54 are a pair of rectangular cross-section reinforcement channels 62 which are welded to the bottom surface of plate 54. Channels 62 provide reinforcement to base 26 to prevent bending and torquing of the frame 12.

Figure 6:
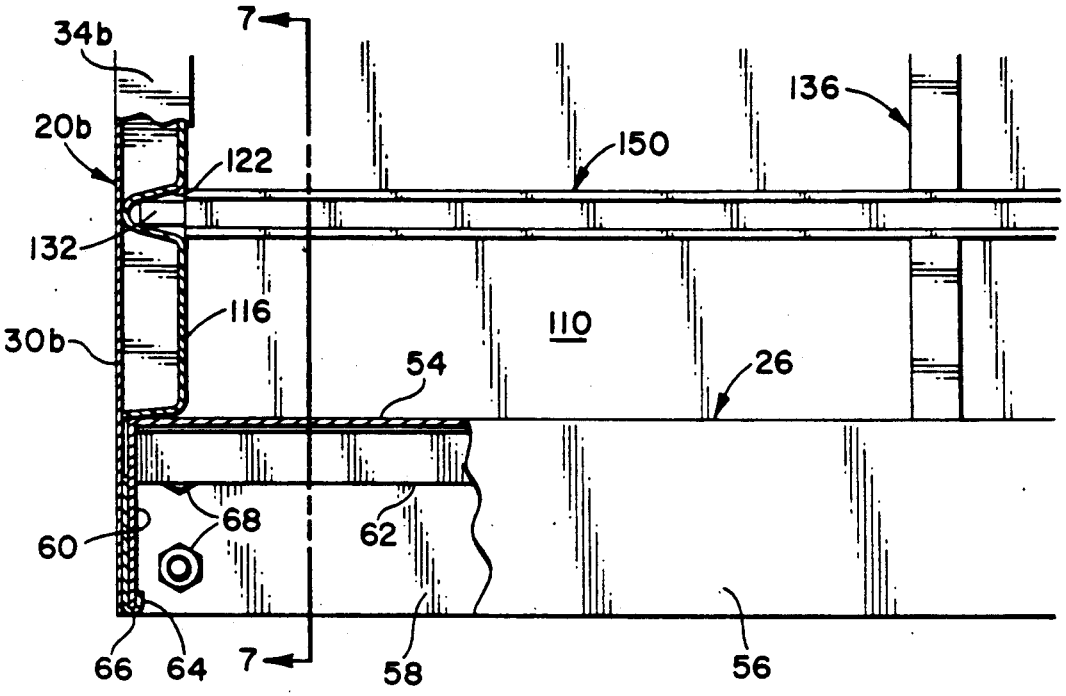
FIG. 6 is a front elevation view, taken partially in section, showing attachment of the side walls to a bottom wall of the cabinet of FIG. 1.
Figure 7:
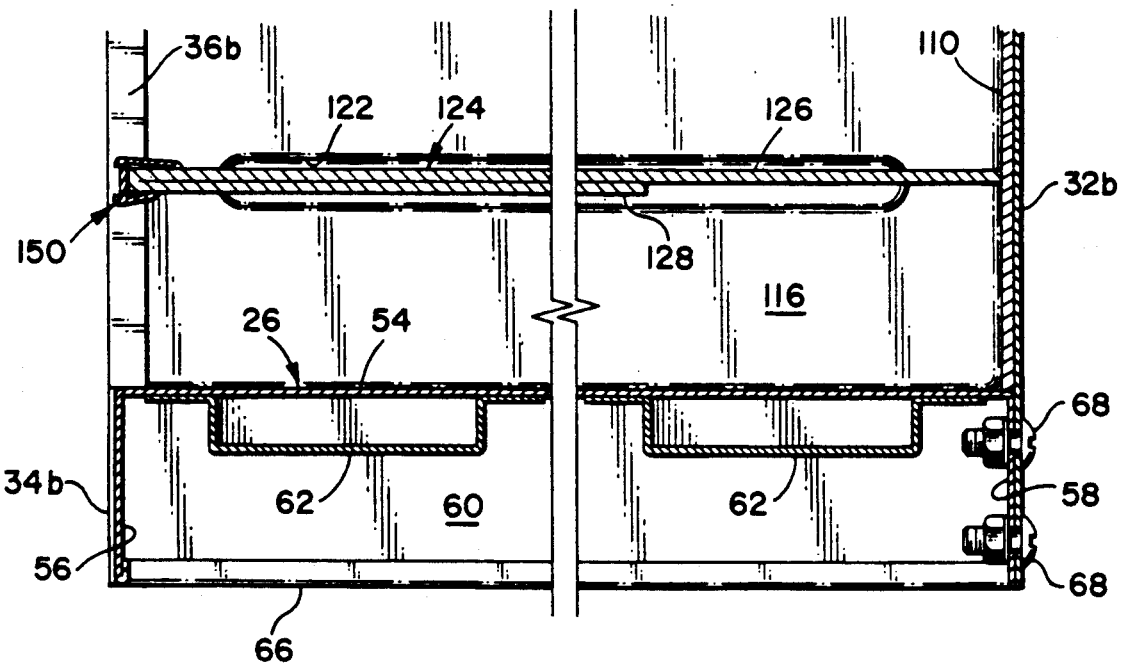
FIG. 7 is a view taken along line 7—7 of FIG. 6.

The frame 12 is assembled by the bottom side wall halves **20*b*, 20*b'* first being connected to base 26. With best reference to FIG. 6, side wall 20*b* is shown attached to base 26. An attachment plate 64 is provided against the inside lower edge of wall 20*b* and secured thereto by spot welding or any suitable means. A lower edge of attachment plate 64 is provided with an upwardly turned end 66 to provide a U-shaped channel sized to receive a free edge of side flange 60. Bolt and nut attachment means 68 are provided passing through rear edge flange 32b of panel 20b and through aligned holes in back edge flange 58 of base 26**.

With the construction as described, base 26 is attached to the side wall 20b in two manners. The first is the receipt of side edge flange 60 within U-shaped channel 66 and the second is the bolt attachment of flange 58 to rear edge flange 32b. Right lower side wall segment 20b' is attached to base 26 in a manner identical to the attachment of segment 20b.

After panels 20b and 20b' have been attached to base 26, intermediate shelf 28 is attached to the top edges of panels 20b and 20b'. With best reference to FIGS. 8 and 9, the reader will note that the top edges of side wall portions 20b, 20b' are provided with a first mounting plate in the form of a snap plate 70. The plate 70 runs the entire width of panels 20b, 20b' (i.e., the distance between forward edge flange 48 and rear edge flange 50). Plate 70 includes a lower attachment end 72 which is welded approximately to the interior surface of plate 30b. A spacer flange 74 spaces a fastening plate 76 of snap plate 70 in space relation to plate 30b. Snap plate 70 is formed of plate steel which is resilient, with plate 76 being resiliently biased toward plate 30b. An upper edge 78 of plate 76 is bent outwardly away from plate 30b and is provided with holes 80 for receiving a screwdriver or other similar suitable tool so that an operator may engage end 78 and force plate 76 against its natural urging away from plate 30b.

Figure 8:
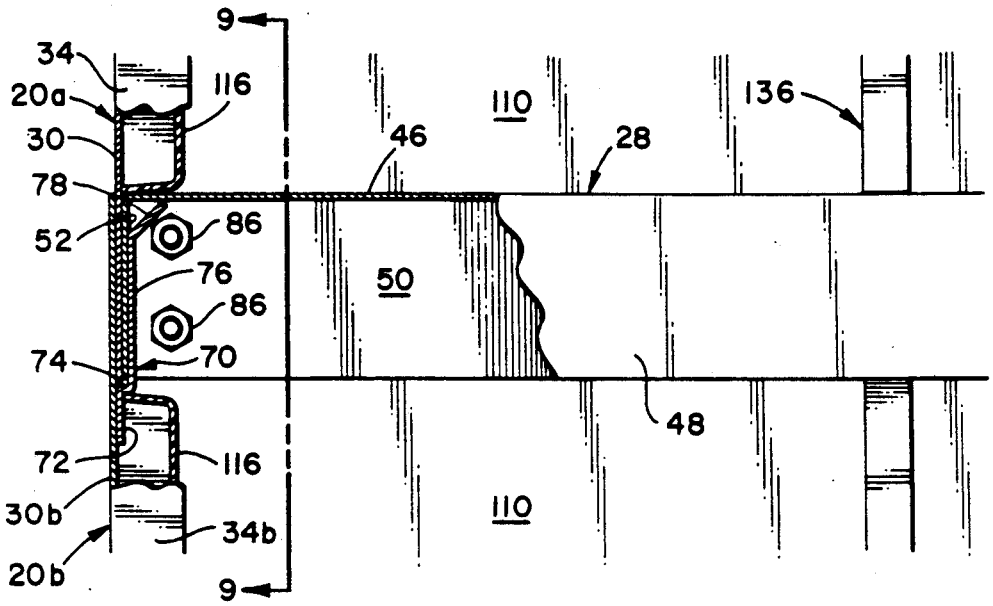
FIG. 8 is a front elevation view, taken partially in section, showing attachments between upper and lower side wall halves at an intermediate shelf.

Plate 70 is sized to receive side edge flange 52 of intermediate shelf 28 and a lower edge of plate 30 of upper side half portion 20a. The flange 52 acts as a cooperating second mounting plate to join with snap plate 70. Both of side half portion 20a and side edge flange 52 are provided with rectangular-shaped openings 82 (see FIG. 2) which are disposed to be in alignment when the side half 20a and side edge flange 52 are received between plate 76 and plate 30b as shown in FIG. 8.

Figure 9:
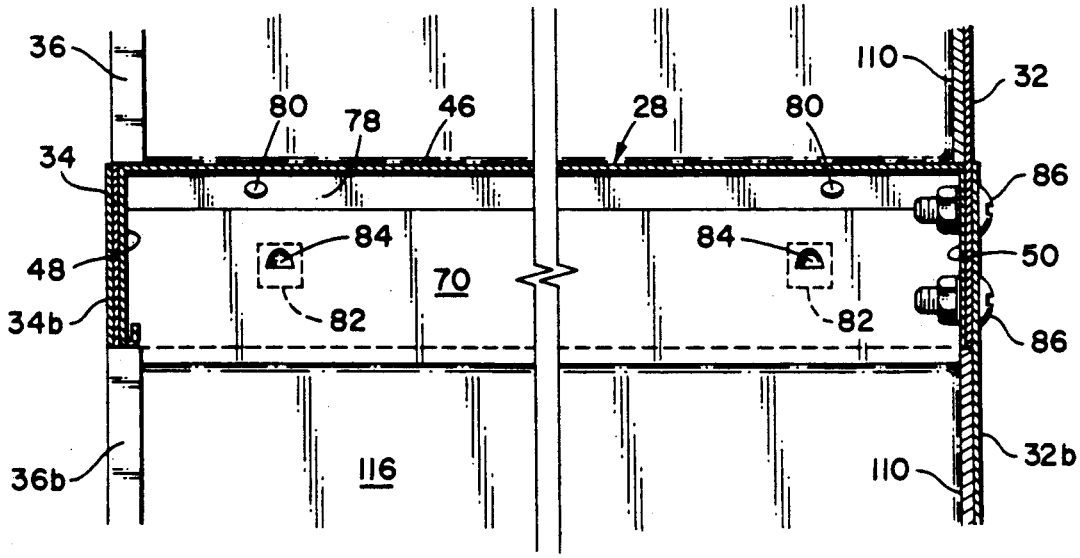
FIG. 9 is a view taken along line 9—9 of FIG. 8.

Plate 76 is provided with tabs 84 which protrude toward plate 30b. Tabs 84 are disposed on plate 76 to be aligned with holes 82 when shelf 28 and upper side half 20a are installed, as best shown in FIG. 9. The tabs 84 are captured within the holes 82 to prevent the shelf 28 and upper side half 20a from being removed from lower half 20b unless an operator forces plate 76 away from plate 30b by inserting a tool within holes 80 as previously indicated.

In addition to the above, bolt and nut fastening means 86 are provided passing through aligned holes in rear flanges 32, 32b of upper and lower side halves 20a, 20b, and rear edge flange 50 of intermediate shelf 28. Accordingly, the tabs 84 and bolt and nut combinations 86 provide a dual mechanism for connecting intermediate shelf 28 with side halves 20a, 20b. Shelf 28 is attached to side halves 20a' and 20b' in an identical manner.

Top wall 24 is next attached to the top edges of upper side halves 20a, 20a', in a manner similar to the connection of shelf 28 to side halves 20b, 20b'. To illustrate this connection, reference is best directed to FIGS. 4 and 5. As shown in FIGS. 4 and 5, a snap plate 90 is provided with an attachment end 92 welded to an inner surface of upper plate 20a. A step flange 94 spaces a fastening plate 96 from plate 30. The plate 96 is resiliently biased toward plate 30. An upper edge 98 of plate 96 is bent outwardly away from plate 30 and is provided with holes 100 in which an operator may insert a screwdriver or similar tool for urging plate 96 against its bias away from plate 30.

Plate 96 is sized to receive side edge flange 44 of top wall 24 between plate 96 and plate 30. Flange 44 is provided with holes 102 (see FIG. 2) which are disposed to be aligned with tabs 104 protruding from plate 90 when flange 44 is received between plate 96 and plate 30 as shown in FIGS. 4 and 5. Bolt and nut fastening means 106 are provided passing through aligned holes of rear edge flange 32 and flange 42 (see FIG. 5). Top shelf 24 is connected to upper side wall half 20a' in a manner identical to that described above.

With the construction as described, frame members 20a, 20b, 20a', 20b', 24, 28 and 26 are joined to form a rigid frame. With the fastening mechanisms as described, the frame may be easily assembled by low-skilled personnel. Also, with the construction as described, no fastening hardware is exposed through the front of the frame or on exposed side walls. Instead, all hardware (such as the heads of bolts 68, 86, and 106) are only exposed through the rear of the frame, which, in practice, is commonly abutting a wall and out of view to the public. As a result of this fastening structure, only clean, unobstructed lines of the frame are exposed. The reader will note from inspecting FIGS. 1, 2 and 4–9 that all fastening elements (such as plates 64, 70 and 90) are fully enclosed within the frame and out of view to a person inspecting the exterior of the frame.

With the frame thus constructed, two interior portions 14 are defined by the frame. The interior portions are separated by intermediate shelf 28. Each of interior portions, in a preferred embodiment, receives an identical divider system 16 for dividing the interior 14 into a plurality of compartments 18. To illustrate this construction, attention is directed to FIG. 2.

As noted in FIG. 2, a flat rectangular back wall 110 is provided which, in a preferred embodiment, is formed of cardboard folded along two fold lines 112, 114 so that the cardboard back wall 110 can be folded in thirds to facilitate shipment of the disassembled product.

The opened back wall 110 (as shown in FIG. 2) is inserted within the frame interior abutting rear edges 32. To hold the back wall 110 in place, interior side moldings 116 are provided. Both left and right side moldings 116 are provided for insertion within side walls 20a, 20a', 20b and 20b'.

Each of moldings 116 is identical. Side wall molding 116 is preferably vacuum molded plastic and is a flat panel sized to have its forward edge 118 (see FIG. 2) received behind forward flange 36, with the panel extending from forward edge 118 to a rear edge 120. With this construction, the panel 116 is snugly received within side wall portions 20a, 20a', 20b, 20b' and act to hold rear back wall 110 in place. Side wall moldings 116 are symmetrically designed to assist in easy installation.

Side wall panels 116 are provided with preformed slots 122 which are horizontal and aligned with the slots on an opposing panel 116. The slots 122 hold the horizontal shelves or dividers 124.

Figure 3:
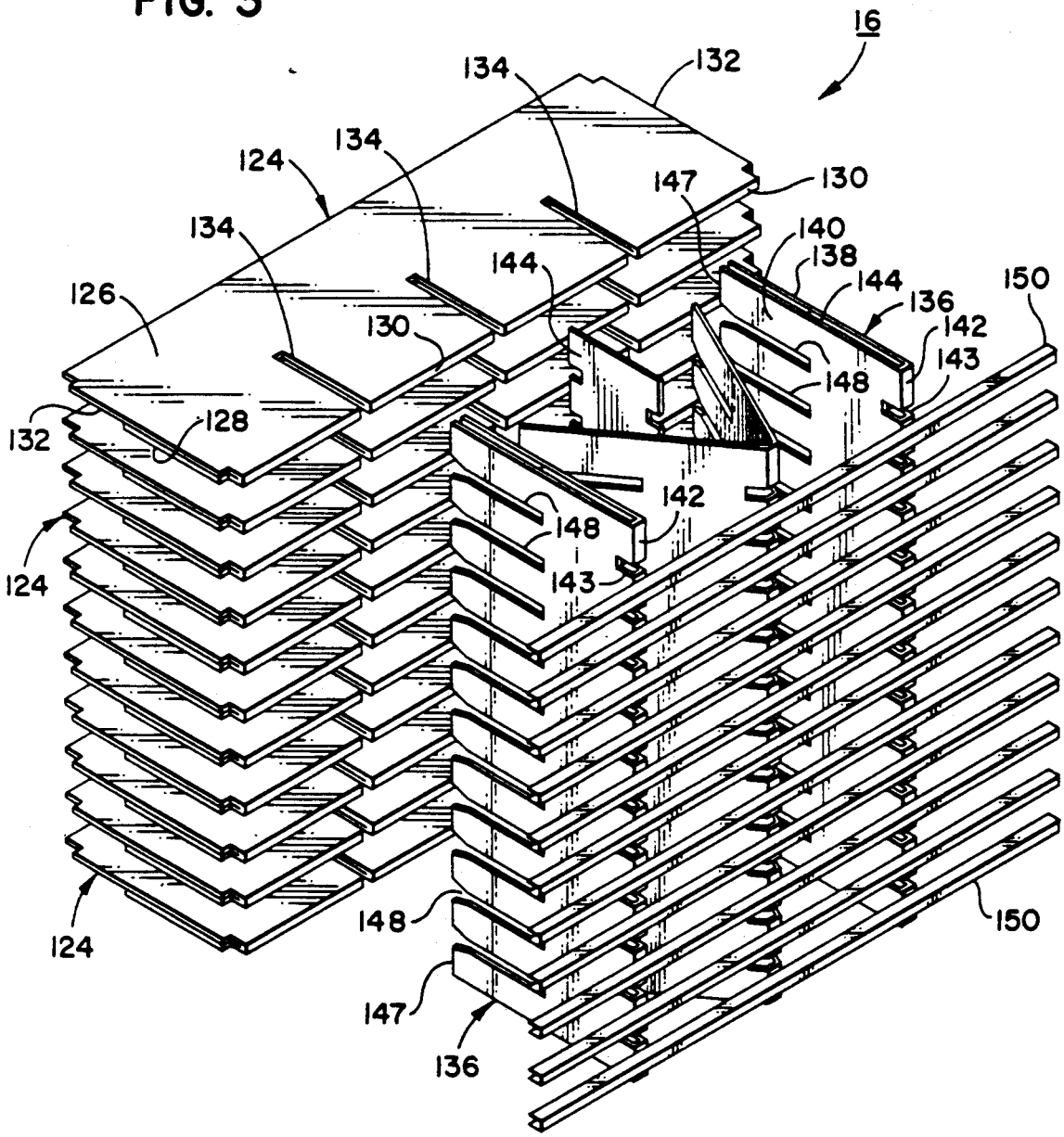
FIG. 3 is a top, front and left side exploded view of divider elements of the cabinet of FIG. 1.

Shown best in FIG. 3, all of the horizontal dividers 124 are identical and are preferably formed from corrugated fiberboard and include a top half 126 and a bottom half 128 folded over to present a leading edge 130, and extending between side edges 132. The side edges 132 are received within slots 122 to hold each of horizontal dividers 124 in spaced apart generally parallel alignment. Each of horizontal dividers 124 has slots 134 formed through each of panel halves 126, 128 at leading edge 130 so that when the dividers 124 are received between slots 122, the slots 134 are aligned to define spaced apart vertical slots extending the height of the cabinet interior.

Vertical dividers 136 are provided to be received within aligned slots 134. Each of vertical dividers 136 is preferably formed of corrugated fiberboard, including a right half 138 and a left half 140 folded over in opposing relation and defining a leading edge 142. For added rigidity, a corrugated fiberboard reinforcing plate 144 is received between halves 138 and 140 adjacent to leading edge 142. A rear edge 147 of the vertical dividers 136 is provided with spaced apart slots 148 disposed to align with slots 134 of the spaced apart horizontal dividers 124. With the construction thus described, horizontal dividers 124 and vertical dividers 136 are interlocked to form a grid as shown in FIG. 1.

Label holders 150, preferably formed from extruded plastic, are provided to be attached to leading edges 130. With reference to FIG. 5, the label holders 150 have a forward surface 152 provided with a slot 154 to receive identification labels so that each of the compartments may be separately identified as to their content. Upper and lower retaining plates 156, 158, respectively, secure the label holder 150 on to leading edges 130. The longer upper plate 156 provides for easy installation. Leading edge 142 of vertical dividers 136 has slots 143 (see FIG. 3) to receive the label holders 150.

With the construction thus described, the reader will appreciate that the entire cabinet may be disassembled into a plurality of small units so that the entire cabinet can be easily shipped. The novel construction technique permits an operator to assemble the frame with ease and with minimal instructions in a short period of time. The resulting cabinet so constructed is durable and resistant to bending and torquing. Also, the novel side plates 116 permit a collapsible back wall 110 to be utilized and retain the dividing members 124, 136 in proper alignment to define individual compartments.

From the foregoing detailed description of the invention, it has been shown how the objects of the invention have been obtained in a preferred manner. However, modifications and equivalents of the disclosed concepts, such as those which readily occur to one skilled in the art, are intended to be included within the scope of this invention. Accordingly, the scope of the present invention is intended to be limited only by the scope of the claims which are appended hereto.

What is claimed is:

1. A cabinet comprising:

(a) a frame defining a cabinet interior;

(b) divider means for dividing said interior into a plurality of storage compartments;

(c) said frame including:

(1) a plurality of walls including a first set of opposing side walls joined by opposing top and bottom walls;

(2) bottom wall attaching means for attaching said bottom wall to said side walls of said first set;

(3) top wall attaching means for attaching said top wall to said side walls of said first set;

(d) said top wall attaching means including:

(1) a first mounting plate disposed upon at least one of said side walls of said first set and resiliently urged against said one side wall;

(2) a second mounting plate carried on said top wall and sized to be urged between said one side wall and said first mounting plate;

(3) latch means for latching said second mounting plate between said first mounting plate and said one side wall, said latching means including apertures formed in one of said first and second mounting plates and tabs disposed on another of said first and second mounting plates to be received within said apertures;

(e) a second set of opposing side walls including at least one of said second set having a free end sized to be inserted together with said second mounting plate between said one side wall of said first set and said first mounting plates.

2. A cabinet according to claim 1 wherein said bottom wall attaching means includes means for defining a channel on a lower edge of said side walls and sized to receive a lower edge of said bottom wall.

3. A cabinet according to claim 1 wherein said divider means includes side inserts sized to be disposed within said side walls, with said inserts disposed in opposing relation and defining means for holding a plurality of divider elements.

4. A cabinet according to claim 3 comprising a back wall formed of a plurality of collapsible elements, with said back wall disposed between said side wall inserts, and said side wall inserts opposing elements of said side walls maintaining said back wall in an uncollapsed position.

5. A cabinet comprising:

(a) a frame defining a cabinet interior;

(b) divider means for dividing said interior into a plurality of storage compartments;

(c) said frame including:

(1) a plurality of walls including opposing side walls joined by opposing top and bottom walls;

(2) bottom wall attaching means for attaching said bottom wall to said side walls;

(3) top wall attaching means for attaching said top wall to said side walls;

(d) said bottom wall attaching means including:

(1) a flange disposed on said bottom wall and extending to a downwardly projecting free lower edge;

(2) a mounting plate disposed on an interior surface of said side wall against a lower edge thereof and including means for defining an upwardly opening channel sized to receive said lower edge of said flange, said channel and said lower edge sized and positioned for said side wall to extend to close proximity to a floor when said bottom wall is attached to said side walls and when said cabinet is placed on said floor with said bottom wall opposing said floor.

6. A cabinet according to claim 5 wherein said top wall attaching means includes a first mounting plate disposed on at least one of said side walls and resiliently urged against said one side wall;

a second mounting plate carried on said top wall and sized to be urged between said one side wall and said first mounting plates;

latch means for latching said second mounting plate between said first mounting plate and said one side wall, said latching means including apertures formed in one of said first and second mounting plates and tabs disposed on another of said first and second mounting plates to be received within said apertures.

7. A cabinet comprising:

(a) a plurality of walls including a first set of opposing side walls joined by opposing top and bottom walls;

(b) bottom wall attaching means for attaching said bottom wall to said side walls with means for defining an upwardly opening channel on a lower edge of said side walls and sized to receive a downwardly projecting lower edge of said bottom wall, said channel and said lower edge sized and positioned for said side wall to extend to close proximity to a floor when said bottom wall is attached to said side walls and said cabinet is placed on said floor with said bottom wall opposing said floor;

(c) top wall attaching means for attaching said top wall to said side walls and including:

(1) a first mounting plate disposed upon at least one of said side walls and resiliently urged against said one side wall;

(2) a second mounting plate carried on said top wall and sized to be urged between said one side wall and said first mounting plate;

(3) latch means for latching said second mounting plate between said first mounting plate and said one side wall, said latching means including apertures formed in one of said first and second mounting plates and tabs disposed on another of said first and second mounting plates to be received within said apertures;

(d) a second set of opposing side walls including at least one of said second set having a free end sized to be inserted together with said second mounting plate between said one side wall of said first set and said first mounting plates.

* * * * *